US006122950A

United States Patent [19]

Rosenthal et al.

[11] Patent Number: 6,122,950

[45] Date of Patent: Sep. 26, 2000

[54] HOT ROLLING TRAIN FOR ROLLING THIN STRIPS

[75] Inventors: Dieter Rosenthal, Niederfischbach; Günter Kneppe, Hilchenbach; Dieter Ladda, Hilchenbach, all of Germany

[73] Assignee: SMS Schloemann-Siemag Aktiengesellschaft, Düsseldorf, Germany

[21] Appl. No.: 09/196,379

[22] Filed: Nov. 19, 1998

[30] Foreign Application Priority Data

Nov. 21, 1997 [DE] Germany ..... 97 120 406

[51] Int. Cl.[7] ..... B21B 27/06; B21B 41/00

[52] U.S. Cl. ..... 72/202; 72/200; 72/227

[58] Field of Search ..... 72/200, 201, 202, 72/229, 227, 234, 366.2, 365.2; 29/527.7

[56] References Cited

U.S. PATENT DOCUMENTS 4,829,656 5/1989 Rohde ..... 72/200

5,080,727 1/1992 Aihara et al. ..... 148/11.5 R 5,435,164 7/1995 Di Giusto et al. ..... 72/202

5,461,770 10/1995 Kimura et al. ..... 29/527.7

5,511,303 4/1996 Tippins et al. ..... 72/202

*Primary Examiner*—Rodney Butler

*Attorney, Agent, or Firm*—Friedrich Kueffner

[57] ABSTRACT

A hot rolling train with a walking beam furnace, a reversing stand following the walking beam furnace and possibly shears and/or descaling devices, as well as a subsequent hot strip finish-rolling train for manufacturing thin, austenitically rolled hot strip is retrofitted with an equalizing furnace provided between the reversing stand and the hot strip finish-rolling train, wherein the equalizing furnace has a number of receiving locations for strips to be heated for equalizing the strip in order to ensure a total heating time for each preliminary strip which is a multiple of the rolling time and the hot strip finish-rolling train.

10 Claims, 2 Drawing Sheets

HOT ROLLING TRAIN FOR ROLLING THIN STRIPS

BACKGROUND OF THE INVENTION

1. Field of the Invention

The present invention relates to an existing hot rolling train with a walking beam furnace, a reversing stand following the walking beam furnace and possibly shears and/or descaling devices, as well as a subsequent hot strip finish-rolling train for manufacturing thin, austenitically rolled hot strip.

2. Description of the Related Art

A large number of hot strip rolling trains of the above-described type are in use today. These hot strip rolling trains make it possible to roll hot strip with a thickness of 1.5 mm, or at best 1.2 mm. This is where these hot strip rolling trains reach there limits. A further lowering of the rolled strip thickness is not possible in these trains. There are two reasons for this: on the one hand, the average temperature of the strip at the exit of the last stand of the hot strip finish-rolling train should not drop below about 890° C. to 930° C. in order to ensure an austenitic rolling. On the other hand, the speed at the exit of the last stand of the hot strip finish-rolling train may not exceed about 11.0 to 12.5 m/s, since otherwise the hot strip could no longer be guided without problems on the runout roller table and subsequently reeled. In addition, the threading-in in the hot strip train is problematic in the case of such high speeds.

The slabs are rolled into a preliminary strip in several passes in the roughing train of a hot strip rolling train. A temperature wedge is formed over the length of the preliminary strip which is essentially influenced by the thickness reduction distribution during rolling and the rolling speeds.

In addition, a distribution of the strip temperature over the width of the preliminary strip occurs during the rolling procedure. This results from greater radiation losses at the strip edges and the cooling effect of the descaling water. Consequently, the strip edges may be substantially cooler than the strip center, wherein temperature differences between the strip center and the strip edge in the order of magnitude of 75° C. to 125° C. are possible.

Thus, preliminary strip which is usually introduced into the hot strip finish-rolling train of the hot rolling train has at its edges a temperature level at the lower limits of the temperature necessary of the first roll stand of the hot strip finish-rolling train, but its strip center temperature is still too high. As mentioned above, the strip center temperature at the last stand must be at least about 890° C. to 930° C.

In addition, in the walking beam furnace there are portions of the rolling stock which rest on the beam and are therefore cooled to a greater extent than the remaining portions of the rolling stock, so that the walking beam extending transversely of the rolling direction produces colder areas of the strip extending transversely of the rolling direction of the rolling stock. These so-called skidmarks must also be taken into consideration with respect to the temperature when entering the hot finish-rolling train, wherein the preliminary strip center temperature outside of the skidmarks may still be substantially higher than the strip edge temperature in the areas of the skidmarks.

During rolling in the finishing train, the remainder of the preliminary strip which has not yet been supplied to the rolling process remains on the roller table in front of the finishing table. Consequently, the rearward portion of the preliminary strip remains longer on the roller table when entering the rolling process and is cooled to a greater extent than the beginning of the strip. In order to ensure a constant fixed temperature of the finishing train in spite of this continuously decreasing entering temperature, the rolling speed is continuously increased during rolling. This temperature speed-up compensates for the influences of the decreasing entry temperatures.

In summary, the rolling process in a conventional finishing train is characterized by the following non-constant strip temperatures:

a) non-constant preliminary strip temperature over the strip length;

b) cold areas (skidmarks);

c) non-constant preliminary strip temperatures over the strip width; and d) greater cooling of the preliminary strip end as compared to the preliminary strip beginning during rolling in the finishing train.

SUMMARY OF THE INVENTION

Therefore, it is the primary object of the present invention to modify or retrofit existing hot strip rolling trains which are capable of rolling strip to thicknesses of 1.5 to 1.2 mm in such a way that the rolled strip thickness can be reduced to below 1 mm, wherein the modification or retrofitting should be carried out as inexpensively as possible.

In accordance with the present invention, an equalizing furnace is provided between the reversing stand and the hot strip finish-rolling train, wherein the equalizing furnace has a number of receiving locations for strips to be heated for equalizing the strip in order to ensure a total heating time for each preliminary strip which is a multiple of the rolling time and the hot strip finish-rolling train.

The equalizing furnace makes it possible to equalize the temperatures in the edge areas of the preliminary strip, the strip beginning and the strip end and any existing skidmarks, so that a preliminary strip with a homogenous temperature is produced, wherein the temperature of the preliminary strip leaving the equalizing furnace can be adjusted to the lowest entry temperature necessary for the hot strip finish-rolling train. In all cases, the constant temperature over the length and width of the preliminary strip ensures absolute stationary process conditions in the finishing train. This provides the best possible prerequisite for rolling strips with minimum final strip thicknesses.

If the equalizing furnace is provided with induction heating units, it is possible to heat cooler areas of the strip in a targeted manner or to influence the overall temperature level. If the receiving locations of the equalizing furnace are arranged parallel to each other, the receiving locations can be moved into the rolling line for loading and unloading by a simple parallel horizontal or vertical displacement relative to the rolling line.

By providing transverse conveying units and receiving locations one behind the other, it is possible to include the preliminary strip in a cycle which includes the rolling line, wherein the actual heating unit is arranged parallel to the rolling line.

In accordance with an advantageous feature, the equalizing furnace is constructed as a roller-type furnace in order to ensure that no skidmarks are produced.

If the hot strip rolling train is to roll strip with thicknesses of 1.5 to 1.2 mm, it is possible to move the equalizing furnace out of the rolling line and to move a conventional roller table into the place of the equalizing furnace.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
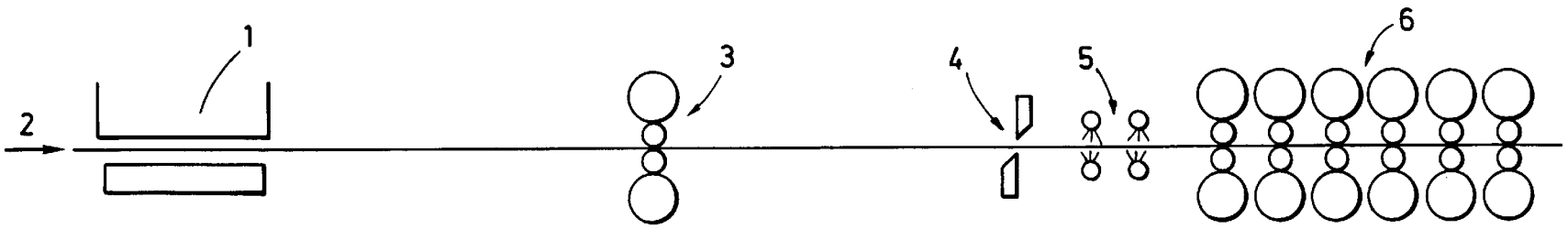
FIG.1 (PRIOR ART)
FIG. 1 is a schematic illustration of a portion of a conventional existing hot rolling train.

FIG. 1 of the drawing shows a walking beam furnace 1 which is followed in the rolling direction 2 by a reversing stand 3. The rolling stock, for example, blooms, is heated in the walking beam furnace 1 and is conveyed from the furnace 1 to the reversing stand 3 where it is rolled in several passes into preliminary strips.

The reversing stand 3 may be followed by a shear 4 and a descaling device 5. Arranged downstream is a multiple-stand hot strip finish-rolling train 6.

Figure 2:
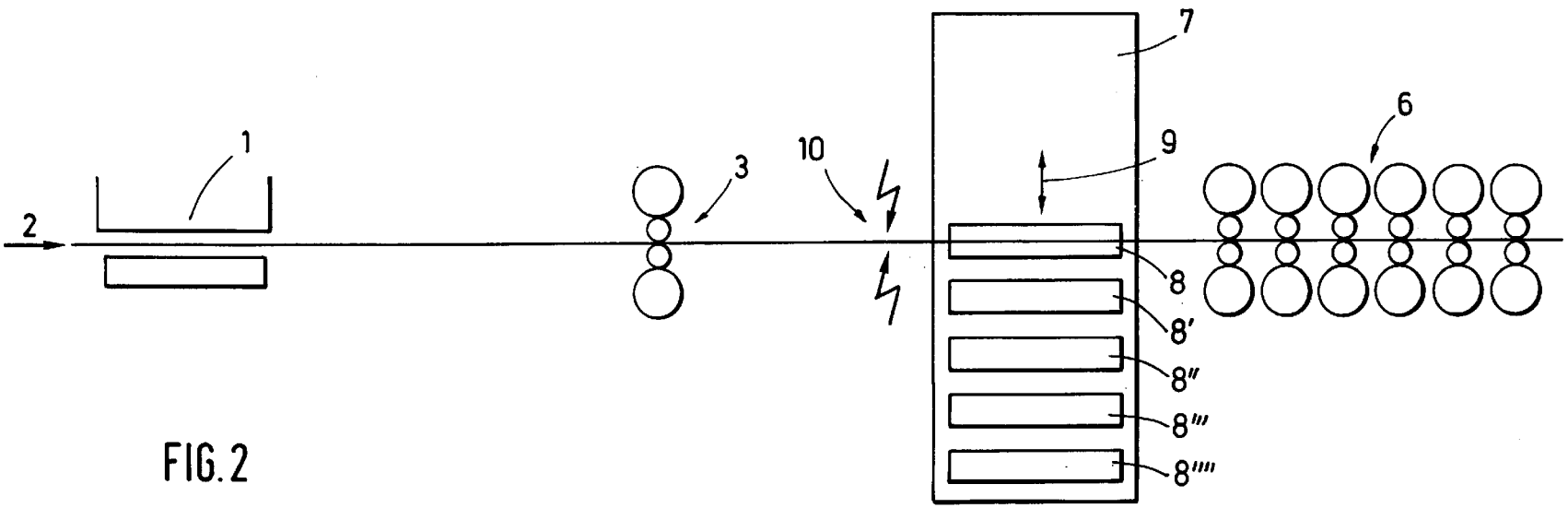
FIG. 2 is a schematic illustration of a retrofitted rolling train according to FIG. 1 with parallel receiving locations for the strip which may be arranged horizontally or vertically relative to the rolling line.

FIG. 2 shows between the reversing stand 3 and the hot strip finish-rolling train 6 an equalizing furnace 7. The equalizing furnace 7 has several receiving locations 8 through 8''''. These receiving locations can be moved in the direction of arrow 9, wherein the arrangement shown in the drawing is applicable to an essentially horizontally arranged equalizing furnace 7 as well as an essentially vertically arranged equalizing furnace 7. An induction heating unit 10 is shown in front of the equalizing furnace 7.

After the blooms arriving from the furnace 1 have been rolled down to preliminary strip thickness, the rolling stock is moved into the equalizing furnace 7. In the equalizing furnace 7, the receiving locations 8 through 8'''' are successively filled and moved step-by-step in the upward direction in accordance with arrow 9 shown in the drawing in FIG. 2. When all receiving locations 8 through 8'''', which may be arranged next to each other or above each other, are filled, they are moved completely downwardly in the direction of arrow 9, so that the receiving location 8 is once again in the rolling line. By introducing a new preliminary strip into the receiving location 8 located in the rolling line, the preliminary strip previously placed in the receiving location 8 whose temperature is now equalized is moved into the hot strip finish-rolling train 6. The end of the preliminary strip remains in the equalizing furnace 7, so that a non-uniform cooling cannot occur. The receiving locations are then moved in such a way that the receiving location 8' is in the rolling line and, also in this case, a new preliminary strip is introduced into the receiving location 8' of the equalizing furnace 7 while simultaneously the previous preliminary strip whose temperature is now equalized is moved out.

Figure 3:
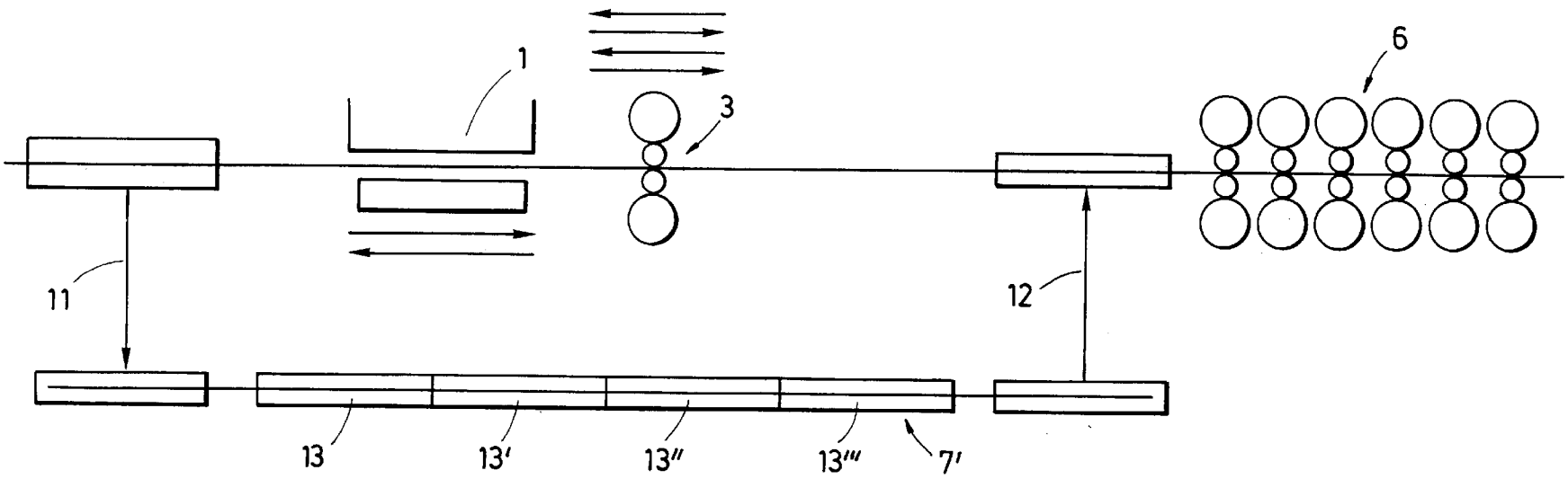
FIG. 3 is a schematic illustration of a rolling train according to FIG. 1 with a retrofitted equalizing furnace with receiving locations arranged one behind the other.

FIG. 3 shows the furnace 1, the reversing stand 3 and the hot strip finish-rolling train 6. FIG. 3 further shows two transverse conveyers 11 and 12 between which are arranged the successively arranged receiving locations 13 through 13''' of the equalizing furnace 7'.

After the bloom arriving from the furnace 1 has been rolled in the reversing stand 3 to the necessary preliminary strip thickness in a reversing operation, the preliminary strip is returned to the transverse conveyer 11 and is moved out of the rolling line into the line of receiving locations 13 through 13'''. After the preliminary strips have been homogenized, they are consecutively moved into the transverse conveyer 12 which brings the preliminary strips back into the rolling line and from there into the hot strip finish-rolling train 6.

While specific embodiments of the invention have been shown and described in detail to illustrate the inventive principles, it will be understood that the invention may be embodied otherwise without departing from such principles.

We claim:

1. A hot strip rolling train comprising a walking beam furnace, at least one reversing stand following the walking beam furnace, and shears and descaling units, and a hot strip finish-rolling train downstream of the reversing stand for manufacturing thin austenitically rolled hot strip, further comprising, for one of reducing a maximum rolling speed and further lowering a rolling strip thickness, an equalizing furnace between the reversing stand and the hot strip finish-rolling train, wherein the equalizing furnace comprises a plurality of receiving locations for heating the preliminary strips to equalize the temperature thereof, wherein the equalizing furnace is configured to ensure a total heating time for each preliminary strip which is a multiple of a rolling time of the strip in the hot strip finish-rolling train.

2. The hot rolling train according to claim 1, wherein the equalizing furnace comprises an induction heating unit which is effective at least in preselectable width areas of the preliminary strip.

3. The hot rolling train according to claim 1, wherein the receiving locations of the equalizing furnace are arranged parallel to each other and the receiving locations are mounted so as to be horizontally displaceable transversely of the rolling direction.

4. The hot rolling train according to claim 1, wherein the receiving locations of the equalizing furnace are arranged parallel to each other and the receiving locations are mounted so as to be vertically displaceable transversely of the rolling direction.

5. The hot rolling train according to claim 1, wherein the equalizing furnace comprises at least one transverse conveyer for at least one preliminary strip, wherein the transverse conveyer is moveable transversely of the rolling direction.

6. The hot rolling train according to claim 1, wherein the equalizing furnace is a roller-type furnace.

7. The hot rolling train according to claim 1, wherein the equalizing furnace is configured to be moveable out of the rolling line.

8. The hot rolling train according to claim 2, wherein the induction heating unit is arranged upstream of the equalizing furnace.

9. The hot rolling train according to claim 2, wherein the induction heating unit is integrated in an entry of the equalizing furnace.

10. The hot rolling train according to claim 5, wherein the receiving locations of the equalizing furnace are arranged one behind the other, and wherein transverse conveyers are provided at both ends of the equalizing furnace.

* * * * *